United States Patent [19]

Fellows

[11] 4,029,989

[45] June 14, 1977

[54] ELECTRIC DISCHARGE LAMP WITH VOLTAGE MULTIPLIER CIRCUIT HAVING A CAPACITANCE WHICH CHANGES WITH TEMPERATURE

[75] Inventor: Mark W. Fellows, Cranbury, N.J.

[73] Assignee: North American Philips Corporation, New York, N.Y.

[22] Filed: Sept. 12, 1975

[21] Appl. No.: 612,717

[52] U.S. Cl. ..... 315/51; 315/50; 315/60; 315/74; 315/112; 315/200 R; 315/203; 315/205; 361/282

[51] Int. Cl.[2] ..... H01J 7/44; H01J 13/46; H01J 17/34; H01J 19/78

[58] Field of Search ..... 315/50, 51, 74, 75, 315/33, 47, 60, 203, 200 R, 234, 112, 115, 116, 117, 118, 205; 317/247, 248, 246; 331/66

[56] References Cited

UNITED STATES PATENTS

| | | | |
|---|---|---|---|
| 2,820,179 | 1/1958 | Crowther | 315/234 |
| 3,243,687 | 3/1966 | Hoh | 317/247 |
| 3,257,607 | 6/1966 | Pintell | 317/247 |
| 3,275,922 | 9/1966 | Meyer et al. | 315/200 |
| 3,280,367 | 10/1966 | Poerschke | 315/200 R |
| 3,600,996 | 8/1971 | Switsen | 315/200 R |
| 3,771,017 | 11/1973 | Switsen | 315/200 R |

*Primary Examiner*—Saxfield Chatmon
*Attorney, Agent, or Firm*—Frank R. Trifari; Robert S. Smith

[57] ABSTRACT

A discharge lamp for connection to an associated alternating current power supply. The lamp is provided with two main electrodes and a starting electrode. Two diodes are connected in series, in cathode to anode relationship, between one associated AC power conductor and the starting electrode. In parallel with the diodes is a first capacitor. Connected to the junction between the diodes is a second capacitor which is connected on the other side thereof to a conductor from the other AC power conductor to the main lamp electrode remote from the starting electrode. In operation the second capacitor substantially changes its capacitance responsive to the temperature present with the lamp to effectively make the voltage doubler inoperative.

5 Claims, 2 Drawing Figures

ELECTRIC DISCHARGE LAMP WITH VOLTAGE MULTIPLIER CIRCUIT HAVING A CAPACITANCE WHICH CHANGES WITH TEMPERATURE

BACKGROUND OF THE INVENTION

The invention relates to discharge lamps and particularly to self-ballasted lamps having a starting electrode. The usual construction for self-ballasted lamps having a starting electrode is an incandescent filament in series with an arc tube. It will be understood that the terms arc tube, discharge tube and burner are used interchangeably herein. Self ballasted lamps designed to operate on 120V power supply having a starting electrode disposed at at least one end thereof. The starting electrode is internal to the arc tube and is in series with a bi-metallic switch. The bi-metallic switch which is external to the 1rc tube is normally closed and opens upon rise in temperature such as is normally encountered by operation. A problem with such bi-metallic switches is that the reliability of the switches often determines the life of the lamp. Since such lamps are frequently used for applications where the service life is particularly important it is highly desirable to provide lamps having a greater service life. It will be understood that in those lamps utilizing the bi-metallic or thermal switch that if the switch does not close at all the main electrode is never heated by the heater coil. The lamps customarily do not have sufficient potential across the burner to initiate electron emission without benefit of the heating of the electrode and accordingly starting will not occur. In addition if the switch never opens, the mercury burner is continuously short-circuited and the ballast coil sustains approximately double design operating voltage until it burns out. If the burner does start and the bi-metallic switch does not stay open upon reaching normal steady state operating temperature, blinking will occur. The arc will strike upon opening of the switch and will then be shorted out as the switch recloses. Cyclical operation in this manner will continue until the ballast coil burns out or power is removed.

It is known in discharge lamps to use voltage multiplier circuits to increase the potential between electrodes. Typically they operate continuously during the operation of the lamp. The continuous operation of the doubler circuit is undesirable because it shortens the lift of the starting electrode.

Frequently discharge lamps have required the use of external ballast to limit current to the arc tube or to limit the rate of change of current flow to the arc tube. The use of an external ballast complicates the installation of lamps of the discharge type and accordingly it is particularly desirable to have lamps which are self-ballasted.

Accordingly it is a primary object of the invention to provide a discharge lamp having a high reliability and a long life.

Another object of the invention is to provide a discharge lamp which eliminates the requirement for a thermal switch.

Still another object of the invention is to provide a discharge lamp which is self-ballasted and in which the ballast provides at least a portion of the light output of the lamp.

SUMMARY OF THE INVENTION

In accordance with the invention in one form a discharge lamp is provided for connection to an associated alternating current power supply. The lamp provides a lamp envelope having a base which includes first and second connection means for connection to the associated alternating current power supply. A discharge tube is disposed within the envelope and first and second main electrodes are disposed at first and second ends respectively of the discharge tube. A starting electrode is disposed at the first end of the discharge tube. A first means for voltage multiplying is disposed within the lamp envelope. A second means connects the first means to the starting electrode and one of the main electrodes. The second means includes a capacitor having a capacitance which changes capacitance by a factor of at least 10 times with a temperature change of 175° C and is also disposed within the envelope.

The capacitance changes by a factor of at least ten times between a temperature of 25° and 200° C in one form of the invention. The initial capacitance of the capacitor may be at least 0.01 microfarads and the capacitance after a temperature change of 175° C may be less.

The first means may comprise a capacitor connected in parallel relationship to first and second diodes which are connected in series with the cathode of one connected to the anode of the other and a second capacitor connected to the junction between the diodes and one of the connection means. The capacitors may have a plate-like structure disposed intermediate the diodes and the discharge tube to isolate the diodes from radiant heat energy.

BRIEF DESCRIPTION OF THE DRAWING

The invention will be better understood by reference to the accompanying drawing in which:

Referring now to FIG. 1, there is shown a mercury vapor discharge lamp in accordance with one form of the invention having a base 2 and an envelope 14. It will be understood that the invention, while having primary application to mercury vapor discharge lamps having starting electrodes, also has application to other discharge lamps having starting electrodes. The base 2 includes connection points or terminals 10 and 12 for connection of an associated alternating current power supply (not shown) to the internal circuitry of the lamp. It will be assumed herein that terminal 12 is connected to the neutral of a single-phase power system.

Figure 1:
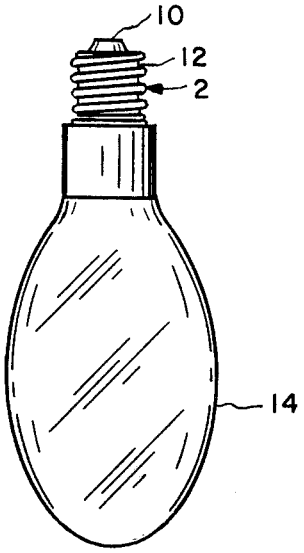
FIG. 1 is a side-elevational view to a reduced scale of a discharge lamp in accordance with the invention.
Figure 2:
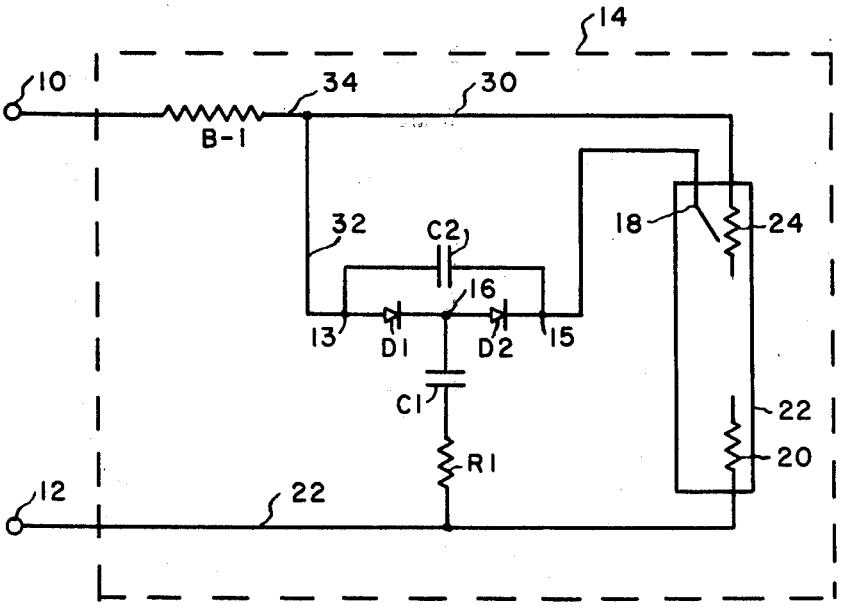
FIG. 2 is a schematic view of one form of the apparatus shown in FIG. 1.

As best shown in FIG. 2, capacitor C-2 is connected across junctions 13, 15 and in parallel relationship to diodes D-1 and D-2 which are connected in series with the cathode of D-1 connected to the anode of D-2 at junction 16. This circuit which comprises capacitor C-2, diodes D-1 and D-2, is connected between terminal 10 and an auxiliary or starting electrode 18. Junction 16 intermediate the cathode of D-1 and the anode of D-2 is connected to a capacitor C-1 which is also connected to conductor 22 which extends between terminal 12 and main electrode 20 which is disposed at the axial extremity of a arc tube 22 remote from the starting electrode. Disposed at the same ends as the auxilliary electrode is a second main electrode 24. A conductor 30 extends from the terminal 10 to the main electrode 24. A conductor 32 extends from junction 34 on conductor 30 to junction 13.

A resistor R-1 in the preferred embodiment is connected in series between the capacitor C-1 and conductor 16. In an alternate embodiment the resistor R-1 may instead be placed in series between the junction 15 and the auxilliary electrode 18. In still other forms of the invention resistors may be used in each of these locations. In the preferred form of the invention the apparatus will include a ballast coil B-1, which will be disposed in series with the terminal 10 and the main electrode 24. In other forms of the invention the ballast coil B-1 may be series with the parallel circuit which comprises capacitor C-2 diodes D-1 and D-2. In still another form of the invention the ballast coil B-1 may be in series between the terminal 12 and mai electrode 20. Ordinarily the ballast coil B-1 will be resistive since this not only serves the primary function of controlling current but also provides additional light output.

Capacitor C-1 is a temperature-responsive capacitor which normally at 25° C will have a capacitance of 0.1 microfarads and at 200° C a capacitance measured in picafarads. It will be seen that at the temperatures present within a lamp which is first turned on the capacitance is relatively large and after the start of the lamp the temperature will rise substantially with the discharge in the discharge tube or burner 22. For convenience in the preferred embodiment capacitor C-2 will be identical to the capacitor C-1 although it is not necessary to the proper operation of the apparatus in accordance with the invention. Diodes D-1 and D-2 are rated at an operating current of 1 amp at 100° C and 50 to 1000 volts. The envelope and discharge tube as well as the electrodes within the discharge tube are conventional structure utilized in discharge lamps known heretofore.

In operation the alternating current applied to terminal 10 will be conducted through the ballast coil B-1 to diode D-1 which will pass only the positive portion thereof. Capacitor C-1 will charge to the peak positive value which passes diode D-1. During the negative half of each cycle diode D-1 will pass no current to capacitor C-1 and capacitor C-1 will discharge. Diode D-1 will prevent reverse current flow back to the ballast coil 20 and the conductor 22 and current will flow through junction 16 to diode D-2. The voltage at the output of diode D-2 will be added to the voltage at the output of capacitor C-2 to produce a peak voltage at junction 15 which is substantially equal to two times the peak voltage between terminals 10 and 12. It will be understood that the peak voltage leaving capacitor C-2 will be essentially that of the peak voltage between terminals 10 and 12 when there is not current draw. Current flow from point 15 to the starting electrode 18 is limited by resistor R-1. In the illustrated embodiment which utilizes resistor R-1 in series between capacitor C-1 and conductor 22 an RC time constant protects capacitor C-1.

It will be understood that the capacitor C-1 upon heating up will drop sharply in capacitance so that effectively no significant charge will build and accordingly the voltage doubler will be effectively switched off. As the lamp cools off the capacitor cools off and recovers its capacitance to begin a new cycle at the time the lamp is again switched on.

The magnitude and duration of the maximum voltage drop across the ballast coil directly affects the life and efficiency thereof. With the doubler circuit in accordance with the invention lamp ballast B-1 immediately after turn-on of the apparatus will have very little load imposed on it. This follows because the impedence of the doubler circuit is much greater than the resistance of the ballast B-1 and there is no current flow across the main electrodes initially. When the arc first strikes across the burner 22 there is essentially a short circuit across the burner and the maximum load is imposed in the ballast. When the burner reaches steady state operation the resistance across the electrodes sharply increases and reduces the load on the ballast. This is in contrast to a conventional self-ballasted mercury vapor lamp with an internal bi-metallic switch. In the conventional structure immediately after being turned on there is a large voltage drop across the ballast because only a heater having a relatively low resitance is in series connection. This voltage drop across the ballast immediately after turn-off is much greater than is necessary in the apparatus in accordance with the invention. The conventional structure maintains this high load on the ballast ordinarily for approximately 15 seconds at which time the bi-metallic switch opens responsive to the heat generated by the heater coil. At this time the potential across the arc tube initiates electron emission from the heated main electrode and the arc strikes the length of the tube. It will be understood that conventional structure imposes a greater voltage drop across the ballast coil for a greater length of time.

It has been found that the location of the resistor R-1 intermediate capacitor C-1 and conductor 22 is particularly desirable since this has the advantage of protecting capacitor C-1 from transients because of the RC time constant. In cold weather applications it is sometimes desirable to connect conductor 32 to terminal 10 instead of connecting it at junction 34 as shown in FIG. 2. This is particularly true for lamp starts at 0° F in a 250 watt self-ballasted mercury vapor lamp.

The voltage multiplier used in the preferred embodiment is particularly desirable for use with the capacitor having the pronounced temperature shift. It will be understood, however, that other voltage multipliers may be used without departing from the spirit of the invention.

It will be seen that the apparatus in accordance with the invention provides a self-ballasted structure which will have improved reliability and longer lamp life. In addition the apparatus in accordance with the invention will also be seen to be cheaper to manufacture in view of the lower cost of the assembly in parts which do not require adjustment as to thermal switches in that the apparatus also utilizes a resistive ballast which provides a portion of the total lamp light output.

Having thus described my invention, I claim:

1. A discharge lamp for connection to an associated alternating current power supply which comprises:

a lamp envelope including a base which includes first and second connection means for connection to the associated alternating current power supply;

a discharge tube disposed within said envelope;

first and second main electrodes disposed at first and second ends respectively of said discharge tube;

a starting electrode disposed at said first end of said discharge tube;

means for voltage multiplying connected to said first and second connection means, said starting electrode and one of said main electrodes, said means for voltage multiplying including a first capacitor having a capacitance which changes capacitance by a factor of at least 10 times with a temperature change of 175° C, said voltage multiplying means disposed within said envelope.

2. The apparatus as described in claim 1 wherein said first capacitance changes by a factor of at least 10 times between a temperature of 25° and 200° C.

3. The apparatus as described in claim 2 wherein the initial capacitance of said first capacitor is at least 0.01 microfarads and said capacitance after a temperature change of 175° C is less.

4. The apparatus as described in claim 3 wherein said means for voltage multiplying comprises a second capacitor connected in parallel relationship to first and second diodes, which are connected in series with the cathode of one connected to the anode of the other, and said first capacitor is connected to the junction between said diodes and one of said connections means.

5. The apparatus as described in claim 4 wherein said first and second capacitors have a plate-like structure and are physically disposed intermediate said diodes and said discharge tube to isolate said diodes from radiant heat energy.

* * * * *